US005201351A

United States Patent [19]

Hurdle, Jr.

[11] Patent Number: 5,201,351

[45] Date of Patent: Apr. 13, 1993

[54] EDGER FOR A CONVENTIONAL SAWMILL

[76] Inventor: Ennis J. Hurdle, Jr., Hwy. 57E, Moscow, Tenn. 38057

[21] Appl. No.: 931,948

[22] Filed: Aug. 17, 1992

Related U.S. Application Data

[63] Continuation-in-part of Ser. No. 867,373, Apr. 13, 1992, abandoned, which is a continuation-in-part of Ser. No. 743,937, Aug. 12, 1991, abandoned.

[51] Int. Cl.[5] ..... B27C 9/00; B27B 1/00

[52] U.S. Cl. ..... 144/39; 83/365; 83/368; 144/3 R; 144/357; 144/369; 356/376; 356/386

[58] Field of Search ..... 83/365, 368; 356/376, 356/384, 385, 386; 144/1 R, 3 R, 39, 356, 357, 369, 370, 373, 374, 377, 378

[56] References Cited

U.S. PATENT DOCUMENTS

| | | | |
|---|---|---|---|
| 3,204,675 | 9/1965 | Griffin | 144/39 X |
| 3,692,074 | 9/1972 | Nilsson | 144/39 |
| 3,880,215 | 4/1975 | Mallery | 144/39 |
| 3,977,447 | 8/1976 | Pease | 144/172 |
| 4,015,648 | 4/1977 | Shepard . | |
| 4,335,767 | 6/1982 | Reuter | 144/370 |
| 4,541,722 | 9/1985 | Jenks | 356/376 |
| 4,848,427 | 7/1989 | Rueter | 144/369 |
| 4,895,197 | 1/1990 | Anderson | 144/369 |
| 4,907,632 | 3/1990 | Reuter | 144/357 |
| 4,947,909 | 8/1990 | Stroud . | |

OTHER PUBLICATIONS 11 page brochure entitled Recovering Up to 15% More from Each Log—Selcon Selective Electronic Group —Optical Triangulation Probe sold in U.S. under trademark "Selcom Optocator".

1 page advertisement—"Temposonics II" Linear Displacement Transducers MTS Systems Corp. Sensors Division May 1991.

2 page Application Note for Temposonic Probe—MTS Sensors Division, Cary, NC dated Feb. 22, 1990.

1 page advertisement—Thomson Industries, Inc., Port Washington, N.Y.—Quickslide System in Machine Design/Apr. 9, 1992.

*Primary Examiner*—W. Donald Bray

*Attorney, Agent, or Firm*—Walker, McKenzie & Walker

[57] ABSTRACT

An edger for use with a conventional sawmill, including upper and lower chippers or cutters for forming the upper and lower edges of a board to be removed from a log, mechanical or optical sizers for automatically determining the location of the upper and lower edges of the board, and a control mechanism, responsive to the sizers, for positioning the cutters. The cutters have horizontal or vertical motors with associated blades, and the motors are mounted on carriages which ride up and down on a mast, positioned by a hydraulic cylinder. Mechanical sizing wheels are mounted on separate carriages, and the wheels are urged to contact the log's surface to determine extreme points of narrowness thereof. The extreme motion points of the sizing wheels are recorded by frictionally secured pistons which are sensed by metallic sensors which are input to the control mechanism. An electric eye causes the sizing wheels to move toward and away from the log. During each forward pass of the log toward the saw, the cutters cut the top and bottom edges off the board that the saw will remove from the log, while the sizers profile the log or locate the minimum width points to be used during the succeeding pass of the log to position the cutters. The single channel or double "H-beam" mast has machined sidewalls to which flanges are attached upon which the carriages slide vertically. Linear slide bearings can also attach the carriages to the mast.

25 Claims, 6 Drawing Sheets

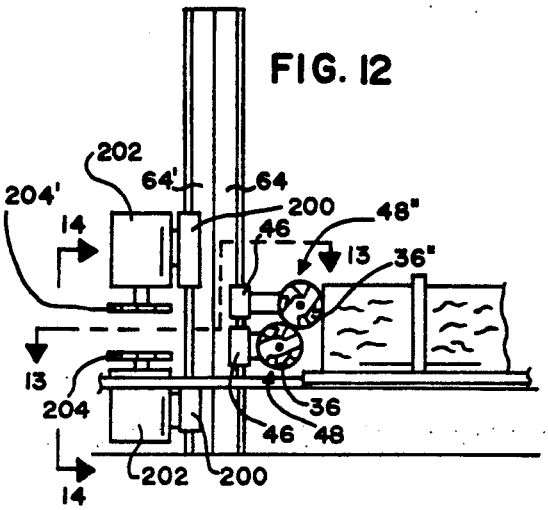
FIG. 12
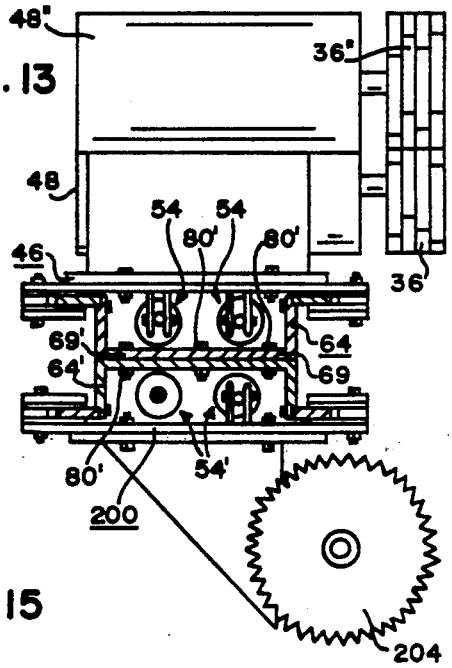
FIG. 13
FIG. 14
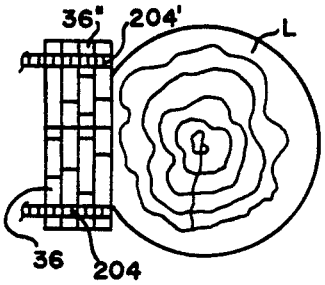
FIG. 15
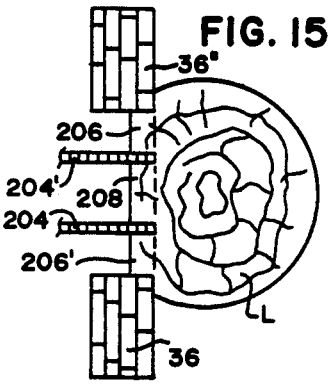
FIG. 16
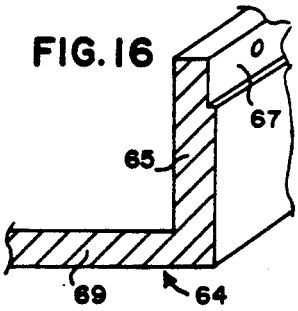
FIG. 17
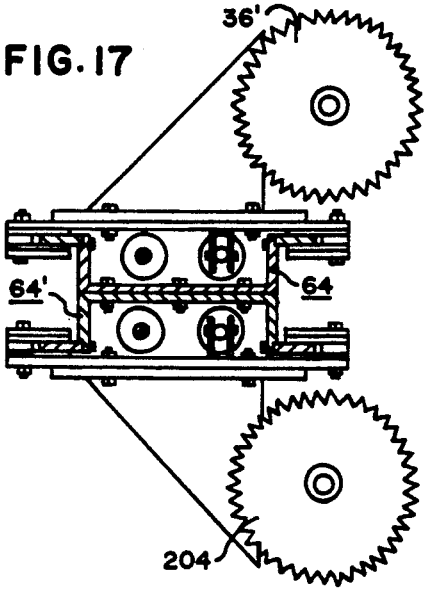
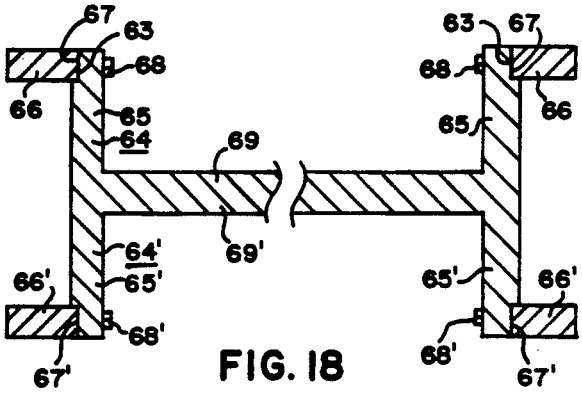
FIG. 18

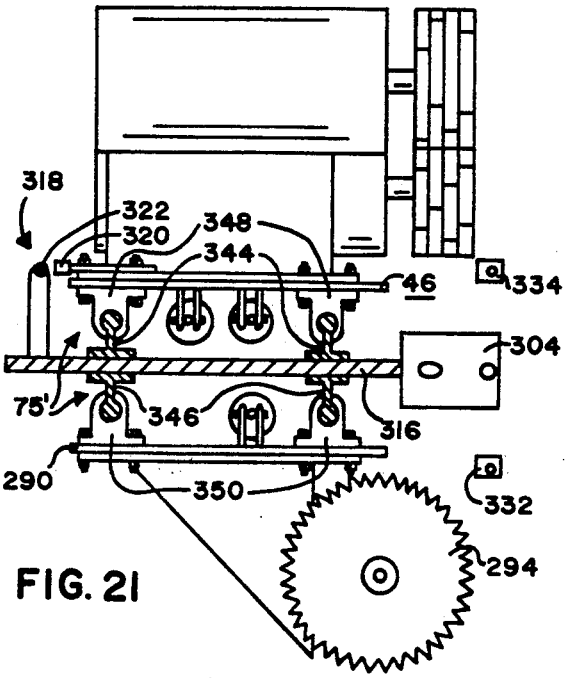
FIG. 21
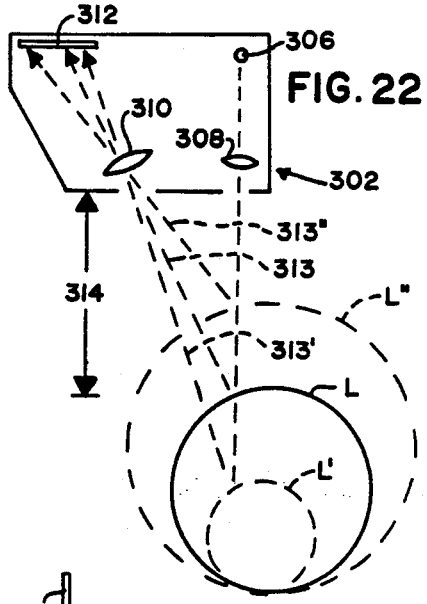
FIG. 22
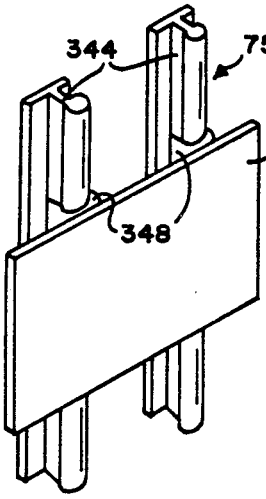
FIG. 23
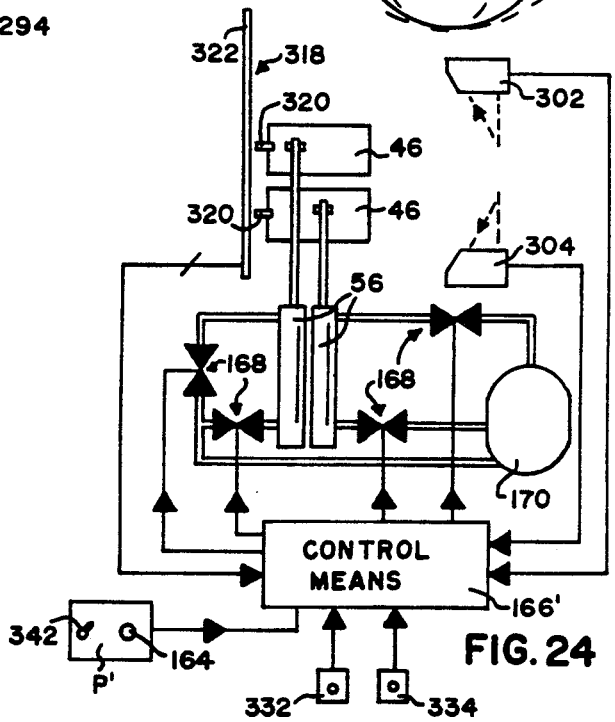
FIG. 24
FIG. 25
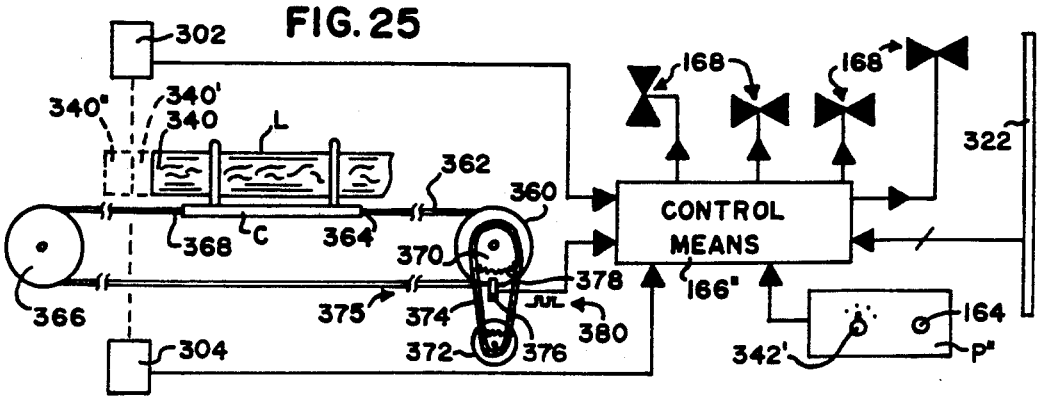

EDGER FOR A CONVENTIONAL SAWMILL

CROSS-REFERENCE TO RELATED APPLICATIONS

This application is a continuation-in-part of U.S. application Ser. No. 07/867,373, filed Apr. 13, 1992, now abandoned entitled EDGER FOR A CONVENTIONAL SAWMILL, which was a continuation-in-part of U.S. application Ser. No. 07/743,937, filed Aug. 2, 1991, entitled EDGER FOR A CONVENTIONAL SAWMILL, now abandoned.

BACKGROUND OF THE INVENTION

1. Field of the Invention

The present invention relates, in general, to sawmills, and in particular, to apparatus for trimming the edges of boards before removal from a log, as well as a to a mast for slidably supporting the cutting means that trim the edges of the boards.

2. Information Disclosure Statement

Sawmills are well known which saw boards from logs. However, the removed boards need to have edges formed on the two sides not cut by the main head saw. Prior known methods for edging boards in a sawmill utilize a vertical shaft with upper and lower blades which move up and down on the shaft for forming the edges of the board to be removed. Prior methods do not automatically size the log, and therefore either require multiple passes of the log if the sizing blades were set too wide, or waste portions of the log by forming a board which is more narrow than necessary if the sizing blades were set too closely.

It is therefore desirable to have an edger which can chip or cut the edges from boards in a sawmill, producing wood chips which can then be used for other purposes such as making paper or as fuel wood. It is also desirable that the sizing of the board and the determination of the correct top and bottom edges of the board be performed automatically, without any guesswork on the part of an operator, and that means be provided for automatically positioning upper and lower cutters where they will cut or chip upper and lower edges from the board at points corresponding to the narrowest vertical dimensions of the log. Furthermore, by utilizing well-known industry grading rules for logs, it is desirable that the edges of the board can be placed so that a maximum-value board will result.

It is further desirable to have a mast capable of slidably supporting and positioning motors that directly drive edging saws or chippers attached to the shafts of the motors. While prior apparatus are known, as mentioned above, that provide for saw blades sliding up and down a vertically rotating shaft, they are not capable of supporting the significant weight of motors that drive the saw blades, thereby precluding the slidable support of such motors.

A preliminary patentability search in Class 144, subclasses 369 and 370, produced the following patents, some of which may be relevant to the present invention: Griffin, U.S. Pat. No. 3,204,675, issued Sep. 7, 1965; Nilsson, U.S. Pat. No. 3,692,074, issued Sep. 19, 1972; Mallery, U.S. Pat. No. 3,880,215, issued Apr. 29, 1975; Pease, U.S. Pat. No. 3,977,447, issued Aug. 31, 1976; Shepard, U.S. Pat. No. 4,015,648, issued Apr. 5, 1977; Reuter, U.S. Pat. No. 4,335,767, issued Jun. 22, 1982; Reuter, U.S. Pat. No. 4,848,427, issued Jul. 18, 1989; and Andersen, U.S. Pat. No. 4,895,197, issued Jan. 23, 1990.

Additionally, during the prosecution of the parent to this application's parent, the following patents were cited by the Examiner: Reuter, U.S. Pat. No. 4,907,632, issued Mar. 13, 1990; and Stroud, U.S. Pat. No. 4,947,909, issued Aug. 14, 1990. Furthermore, applicant has recently become aware of Jenks, U.S. Pat. No. 4,541,722, issued Sep. 17, 1985.

Applicant also knows of an optical triangulation probe sold in the United States under the trademark "SELCOM OPTOCATOR" by Selective Electronic, Inc., P.O. Box 250, Valdese, N.C. 28690, that is used in the logging industry to measure the position of logs passing through a sawmill.

While each of the above references disclose various sawmill edgers and apparatus, none disclose or suggest the present invention. More specifically, none of the above references disclose or suggest an edger for use with a conventional sawmill, said edger comprising upper and lower cutting means for forming the upper and lower edges, respectively, of a board to be removed from a log, each said cutting means comprising: a rotatable blade, means for rotating the blade, and positioning means for moving the blade upwardly and downwardly with respect to the log and for positioning the blade for cutting the respective edge of the board when the blade is placed in contact with the log; said edger additionally comprising sizing means for automatically determining the placement of the upper and lower edges of the board to be removed from the log; and, control means, responsive to said sizing means, for controlling the moving and positioning of the blade of each said cutting means by each said positioning means.

Likewise, none of the above references disclose or suggest an edger for use with a conventional sawmill, said edger comprising: a vertically upright mast; upper and lower cutting means for forming the upper and lower edges, respectively, of a board to be removed from a log, each said cutting means comprising: a rotatable blade; a carriage; sliding attachment mean for slidably mounting said carriage on said mast for upward and downward movement thereupon; rotation means, mounted on said carriage, for rotating the blade; and positioning mean for moving the carriage upwardly and downwardly with respect to the log and for positioning the blade for cutting the respective edge of the board when the blade is placed in contact with the log.

Griffin, U.S. Pat. No. 3,204,675, describes chippers which mill opposing sides off boards. The Griffin device does not work in conjunction with a sawmill, but instead replaces the saw, and does not form boards or the edges of boards, but rather mills the log into a square post.

Nilsson, U.S. Pat. No. 3,692,074, describes a chipping and sawing machine that forms opposite planar surfaces on a log, said surfaces being parallel to the cuts that will be made by a saw blade. The Nilsson invention does not form the edges of the board as does the present invention.

Mallery, U.S. Pat. No. 3,880,215, describes a wood chipper that removes the rough outer surface or slab from a log, forming the planar outer surface of the first board to be cut, but also does not form the edges of the board.

Pease, U.S. Pat. No. 3,977,447, describes a single chipper blade assembly of piecewise varying radius which simultaneously chips three sides of wood scrap having a fourth flat side, forming a board.

Shepard, U.S. Pat. No. 4,015,648, describes a sawmill with a pair of chipping edger blades mounted on a single shaft. The chipper blades form the edges of the board, as does the present invention, but the Shepard device does not have the ability to automatically size the log and adjust the placement of the chipper blades correspondingly.

Reuter, U.S. Pat. No. 4,335,767, describes a method and apparatus for sawing and milling four-sided timber using a pair of carriage-mounted adjustable milling heads and a pair of opposed cutting blades. The Reuter apparatus does not work in conjunction with a conventional sawmill, and discloses no automatic sizing mechanism such as that which is a part of the present invention.

Reuter, U.S. Pat. No. 4,848,427, improves on the above-mentioned prior Reuter patent, and describes an apparatus to cut corners into logs which will form board edges. Still, no automatic sizing mechanism is described.

Andersen, U.S. Pat. No. 4,895,197, describes a method and apparatus for sawing boards from a log at various angles so as to avoid wastage, making two blind cuts into the log which are then connected with a third, longitudinal, cut to form the board, then rotating the log to a new position for removal of another board at a new angle.

Reuter, U.S. Pat. No. 4,907,632, describes a feed apparatus having rollers that move a log through a sawmill. A scanning roller mounted on a pivoted arm is disclosed that contacts the surface of the log, generating a signal that is used to center the log on the feed rollers.

Stroud, U.S. Pat. No. 4,947,909, describes computerized horizontal and vertical scanners that view the outer surface of a log to determine the horizontal and vertical diameters as well as the position of the centerline of the log, and a process to use this information to position cutting heads as the log passes through the sawmill.

Jenks, U.S. Pat. No. 4,541,722, describes a contour line scanner for profiling log cants. A pair of fan-like lasers project coplanar contour lines on the log cant that are then viewed by an overhead camera. The position of the contour lines on the log can be moved, and the resulting grade of a cut board determined. The present invention does not use fan-like lasers to project movable contour lines on the log.

SUMMARY OF THE INVENTION

The present invention is an edger for use with a conventional sawmill. Upper and lower chippers or cutters form the upper and lower edges of a board to be removed from a log by the sawmill, chipping or cutting away excess wood as the log advances toward the sawmill saw. A mechanical or optical sizing means determines the minimum width of the board to be removed, independently tracking the upper and lower surfaces of the log during one pass and locating and recording the extreme lower point of the upper surface and the extreme upper point of the lower surface. Control means, responsive the sizing means, then independently positions the upper and lower cutters for forming the upper and lower edges of the board. While the cutters create the edges of the present board, the sizing means determines the optimum edge locations for the next board to be removed.

The upper and lower cutters each preferably include a motor which rides up and down on a carriage sliding on a mast. Each motor may have a vertical or a horizontal shaft, thus determining the plane of rotation of the blades. The sizing means includes upper and lower sizing wheels mounted on carriages which slide up and down on a mast, being urged against the log and consequently following the minima and maxima of the upper and lower log surfaces.

The mast may have sidewalls with machined outer face portions to which flanges are attached upon which the carriages of the upper and lower cutters slide, or may have linear slide bearings slidably attaching the carriages to the mast.

In a variation of the present invention, the sizing means may be separate from the mast. In addition to the upper and lower cutting means on a front mast, one or more cutting means may be slidably mounted upon a rear mast, allowing multiple boards to be simultaneously edged and cut from the log, thereby producing both high-grade boards, free of knots or other defects, along with lower grade boards that contain such defects.

An improved variation of the present invention samples the position of the upper and lower surfaces of the log and builds a profile of those surfaces, allowing application of industry grading rules to this profile to produce a resulting board with an allowable number of defects and amount of wane.

It is an object of the present invention to provide an edger which can form the edges of a board to be removed from a log, and to also automatically determine the placement of those edges. It is a further object that the automatic edge placement be such as to avoid log wastage, and be related to the minimum width along the log at the point where the board is to be removed. It is an object of an improved embodiment of the present invention to produce the maximum value board of a specified grade from the log using industry grading rules. The edger should preferably remove excess wood from the log as log chips which may then be further processed, as into paper, or used for fuel wood.

BRIEF DESCRIPTION OF THE DRAWINGS

FIG. 12 is a side view of the front and rear masts of the third preferred embodiment of the present invention, showing upper and lower cutting means on each.

FIG. 13 is an enlarged top sectional view of the third preferred embodiment of the present invention showing the details thereof, taken substantially along the line 13—13 shown in FIG. 12 and rotated 90 degrees counterclockwise.

FIG. 14 is a rear view of a slab being chipped from a log by a pair of horizontally offset chippers of the third preferred embodiment of the present invention, taken along the line 14—14 shown in FIG. 12.

FIG. 15 is a rear view, similar to FIG. 14, showing upper and lower chippers forming the outer edges of upper and lower boards while upper and lower saws separate lesser-grade boards from a higher-grade board.

FIG. 16 is a perspective sectional view showing the details of the machined face portion of a sidewall of a mast of the present invention.

FIG. 17 is an enlarged top sectional view of a fourth preferred embodiment of the present invention showing the details thereof, taken in a similar manner as FIG. 13.

FIG. 18 is a horizontal sectional view of a variation of the masts of the present invention in which the front and rear masts share an integral common portion.

FIG. 21 is an enlarged top sectional view of the invention shown in FIGS. 19 and 20, showing the details thereof, taken substantially along the line 21—21 shown in FIG. 20.

FIG. 22 is a diagrammatic view showing the viewing of logs of various diameters by the optical measurement means.

FIG. 23 is a perspective view of a carriage of the present invention slidably attached by linear bearing means to vertical slide rails.

FIG. 24 is a schematic block diagram showing the interconnection of various sensors, control means, and optical measurement means.

FIG. 25 is a partial diagram showing an improvement of the present invention in which the upper and lower surfaces of the log may be profiled in order to apply grading rules thereto.

DESCRIPTION OF THE PREFERRED EMBODIMENTS

Figure 1:
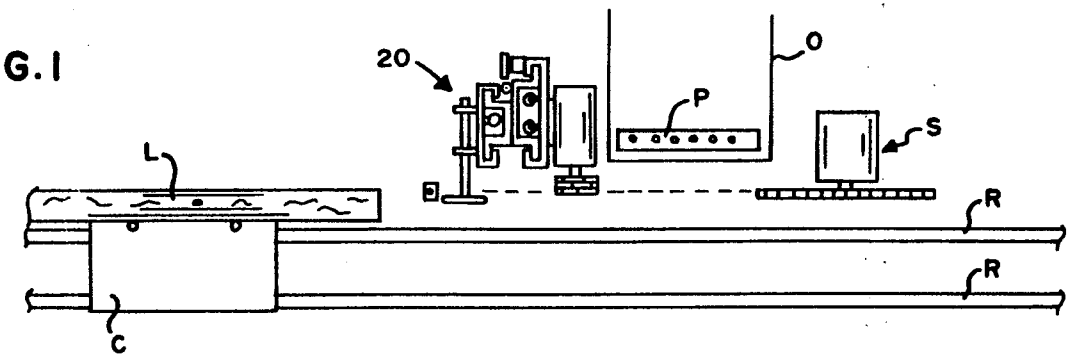
FIG. 1 is a top plan view of the first preferred embodiment of the present invention in use alongside a conventional sawmill.
Figure 2:
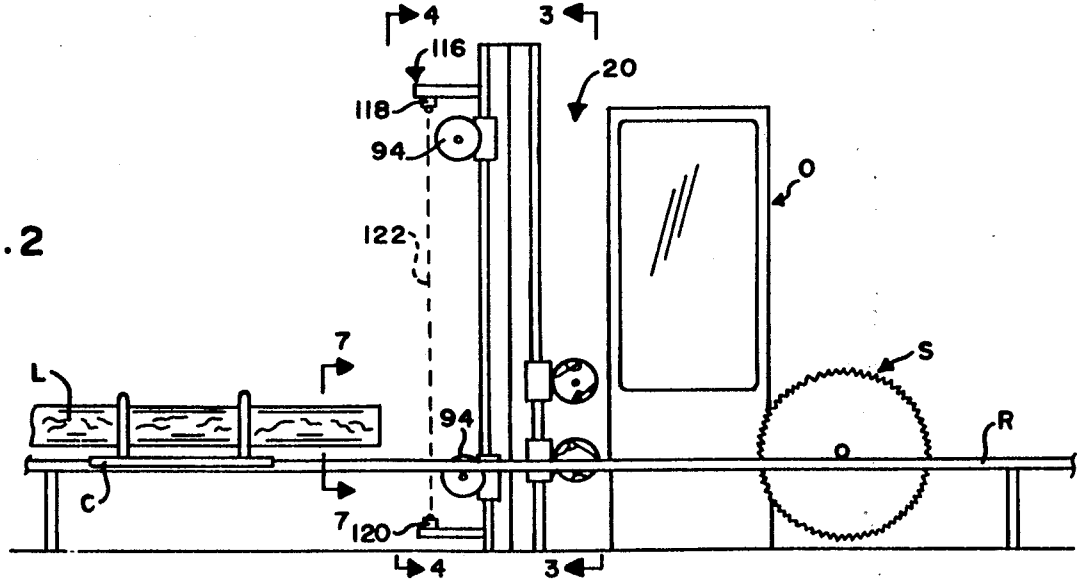
FIG. 2 is a side view of the first preferred embodiment of the present invention alongside a conventional sawmill.
Figure 3:
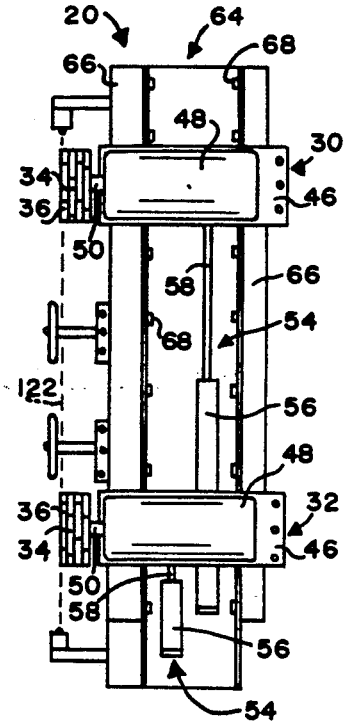
FIG. 3 is a front view of the first preferred embodiment of the present invention taken along the line 3—3 shown in FIG. 2, showing the chipper motors and carriages.

Referring to FIGS. 1 and 2, the edger 20 of the present invention is shown adjacent a conventional sawmill. The sawmill is well known, typically including a saw S and a log carriage C riding on parallel rails R. An enclosed operator's station O is usually provided for safety, with a control panel P. A log L is placed on log carriage C for transport along rails R past the edger 20 and saw S in the usual and well known manner. Carriage C has well known means, not shown, for gripping and moving log L transversely to the path of the carriage along rails R, so that successive vertical saw cuts, as at 22, 24 (shown in a cross section of log L in FIG. 7) may be made into log L to create boards 28, 26 respectively, from log L. Log L will be understood to move in a forward direction toward saw S, i.e., toward the right as shown in FIGS. 1 and 2, and in a rearward direction away from saw S, i.e., toward the left as shown in FIGS. 1 and 2.

Figure 4:
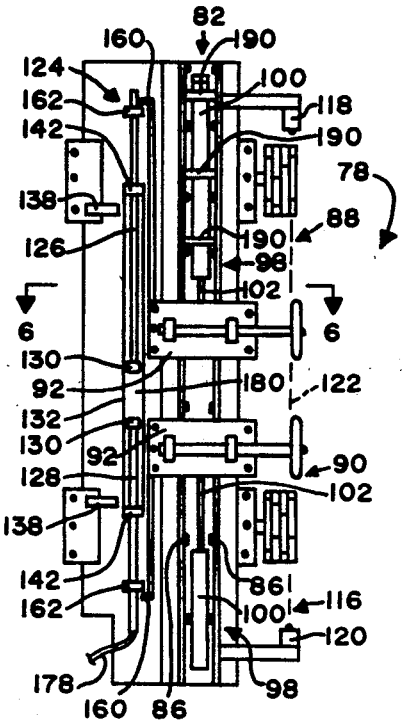
FIG. 4 is a rear view of the first preferred embodiment of the present invention taken along the line 4—4 shown in FIG. 2, showing the upper and lower sizing assemblies.
Figure 5:
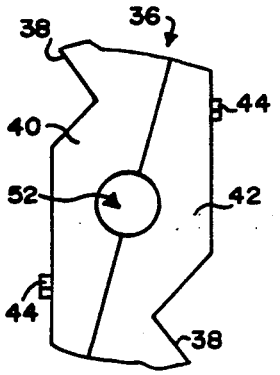
FIG. 5 is a side view of one of the rotary chipping blades, taken along the line 5—5 shown in FIG. 6.

Referring to FIGS. 3–6, edger 20 is seen to include upper and lower chipping or cutting means 30, 32, respectively, for forming the upper and lower edges, such as edges 27, 29, respectively, of board 28, each said cutting means being similar. In the preferred embodiment, each cutting means includes a rotary chipping blade assembly 34, well known to those skilled in the art, each preferably constructed of a stacked multiplicity of rotary chipping blades 36, one of which is shown in FIG. 5. Each chipping blade 36 has one or more sharp chipping portions 38 for chipping away material from log L in the well known manner, and is preferably constructed of substantially similar blade halves 40, 42, held together as by bolts 44. The width of blade assemblies 34 determines the maximum thickness board that may be removed by the sawmill; the width of each blade 36 determines the size of the wood chips removed from log L.

Each cutting means 30, 32 also preferably includes a front carriage 46 and means for rotating blade assemblies 34, preferably a motor 48, mounted on carriage 46 and secured by bolts 47. Blades 36 are securely attached to the shaft 50 of motor 48 in a manner well known to those skilled in the art, shaft 50 extending through hole 52 formed in blade 36 by blade halves 40, 42.

Each cutting means 30, 32 also includes positioning means 54, preferably a well known hydraulic cylinder 56, for moving carriage 46, and hence, blade assembly 34, upwardly and downwardly with respect to log L and for positioning each blade assembly 34 for cutting the respective upper or lower edge, as, for instance, edges 27, 29 of board 28, in a manner hereinafter described. The end of piston 58 of each hydraulic cylinder 56 is attached to its respective carriage 46 in the well known manner, preferably by a pin or bolt 60 passing through flanges 62 extending from the rear of each carriage 46 as shown in FIG. 6.

Carriages 46 move upwardly and downwardly on U-shaped front mast 64. Mast 64, preferably constructed using readily available channel iron, has left and right slides or flanges 66 bolted thereto, as with bolts 68. Carriages 46 slide upwardly and downwardly on lips 70 which surround flanges 66. Base plate 49 of carriage 46 extends across mouth opening 73 of channel 71 of mast 64, hereinafter described. Lips 70 are preferably bolted to carriages 46 using bolts 72 passing through spacers 74, and may also have replaceable wear strips 76 sandwiched between lips 70, carriages 46, and flanges 66 for reducing the frictional forces that otherwise might be present as carriages 46 move upwardly and downwardly. Left and right lips 70 are respectively attached to horizontally opposite sides of base plate 49, each slidably engaging the respective left or right flange 66 on the side of said flange remote from base plate 49 so as to embracingly entrap said respective flange 66 between the respective lip 70 and base plate 49 in a manner that will now be apparent. Left and right lips 70 shall be understood to be one embodiment of sliding attachment means 75 for slidably mounting the carriages to the mast. It will also now be understood that positioning means 54 may move cutting means 30, 32 upwardly and downwardly to meet log L which passes between chipper blades 36.

Figure 6:
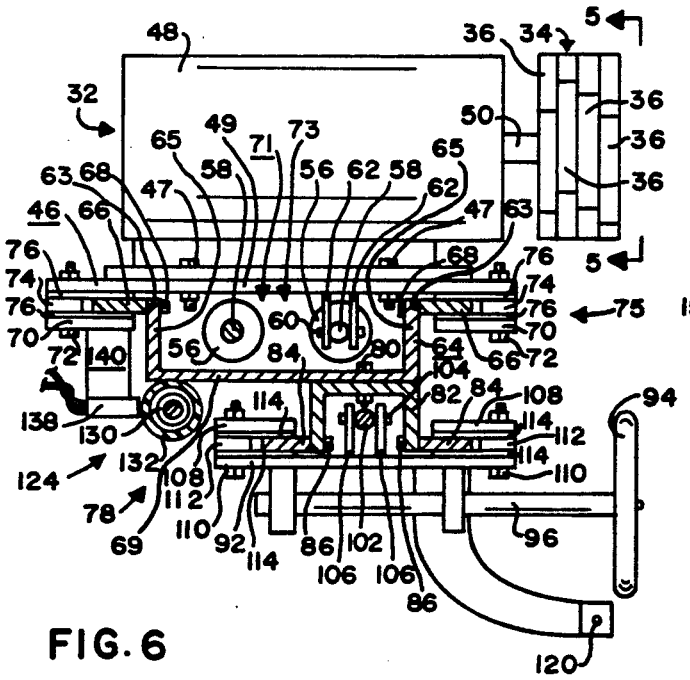
FIG. 6 is an enlarged top sectional view of the first preferred embodiment of the present invention showing the details thereof, taken substantially along the line 6—6 shown in FIG. 4.

Preferably, as shown in FIGS. 6 and 16, vertically upright mast 64 has left and right sidewalls 65, each said sidewalls extending outwardly from back portion 69 of mast 64, with each of sidewalls 65 being in parallel spaced relationship with the other so as to form a vertical channel 71 therebetween, with channel 71 having a mouth opening 73 remote from back portion 69 between sidewalls 65. Also preferably, left and right sidewalls 65 each have a machined and substantially flat outer face portion 67 distant from back portion 69, against which the inner edges 63 of flanges 66 are abuttingly and fixedly attached, as by bolts 68. Without machined face portion 67, it is difficult to create a precision-straight slide with flanges 66 for carriages 46, as the surface of sidewalls 65 will not be sufficiently flat for proper mating abutment with flanges 66. Flanges 66 are seen to extend sidewardly in a plane from sidewalls 65. Hydraulic cylinders 56 are preferably placed within channel 71 as shown.

Referring to FIGS. 4 and 6, log sizing means 78 is shown for automatically determining the placement of the upper and lower edges of the board, as, for instance edges 27, 29 of board 28, to be removed from log L. Bolted to the rear of mast 64, as with bolts 80, is another U-shaped (rear) mast 82, having slides or flanges 84 bolted thereto, as with bolts 86. Preferably, log sizing means 78 includes similar upper and a lower sizing means 88, 90 for determining the upper and lower edges, respectively, of each board.

Each of upper and lower sizing means 88, 90 include similar sizing carriages 92 to which is rotatably mounted a sizing wheel 94 on shaft 96. Positioning means 98, preferably air cylinders 100, urges sizing carriages 92, and hence sizing wheels 94, toward each other to meet log L which passes between sizing wheels 94. The end of piston 102 of each air cylinder 100 is attached to its respective sizing carriage 92 in a well known manner, preferably by a pin or bolt 104 passing through flanges 106 extending from the rear of each carriage 92 as shown in FIG. 6.

Sizing carriages 92 slide upwardly and downwardly on lips 108 which surround flanges 84. Lips 108 are preferably bolted to carriages 92 using bolts 110 passing through spacers 112, and may also have replaceable wear strips 114 sandwiched between lips 108, carriages 92, and flanges 84 for reducing the frictional forces that otherwise might be present as carriages 92 move upwardly and downwardly.

Sensing means, such as well known electric eye 116 comprising a light 118 and a light detector 120, is also provided for detecting the passage of log L between sizing wheels 94. When beam of light 122 is interrupted by log L passing between sizing wheels 94, sensing means 116 causes air to flow into air cylinders 100 to cause sizing carriages 92, and hence, sizing wheels 94, to move together to meet log L in a manner that will now be understood, each respective sizing wheel coming in contact with and remaining urged against the log by each air cylinder 100, following the local minima and maxima of the upper and lower surfaces of log L as the log passes between sizing wheels on carriage C, see FIG. 2. It will be understood that log L is typically not perfectly cylindrical nor straight, its surface having local minima and maxima, i.e., indentations, bumps, and curvatures, along the length thereof. As a bump on log L contacts one of sizing wheels 94, the sizing wheel will be urged away from the log by the bump. As an indentation on the log passes one of sizing wheels 94, the sizing wheel will be urged further toward log L by air cylinder 100, following the contours of log L's surface.

Figure 10:
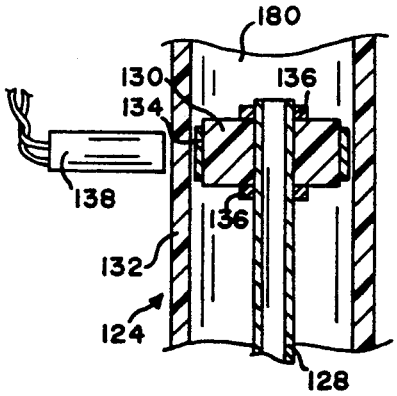
FIG. 10 is a sectional view of a piston and piston position sensing means of the present invention.

A position extremum recording means 124, see FIGS. 4, 6, and 10, responsive to sizing means 88, 90 is mounted adjacent sizing means 88, 90 for recording the extremes of travel of each sizing wheel 94 toward log L, i.e., the lowest point of travel of upper sizing wheel 94 and the highest point of travel of lower sizing wheel 94, thereby recording the narrowest upper and lower points along log L. Recording means 124 comprises a pair of rods, solid upper rod 126 and hollow lower rod 128, to which are attached upper and lower preferably non-metallic pistons 130 which ride loosely within non-metallic and preferably plastic cylinder 132. Pistons 130, attached to rods 126, 288, by clips or nuts 136, have metal rings 134 attached to the circumference thereof, see FIG. 10, for sensing by piston position sensor or sensing means such as well known magnetic sensors 138 mounted to the rear of carriages 46 as on bracket 140. Rods 126, 128 pass through split bushings 142 which may be adjusted, as by turning a screw, not shown, to exert a slight frictional force on rods 126, 128, thereby causing rods 126, 128 to tend to remain stationary unless urged upwardly or downwardly. Obviously, other equivalent means for causing rods 126, 128 to remain stationary against the pull of gravity, while still allowing rods 126, 128 to be urged upwardly or downwardly in a manner hereinafter described, could be provided and still remain within the scope and contemplation of the present invention.

In operation, log L begins at the far left of FIG. 1. Light beam 122, detected by detector 120 as being unbroken, causes control means 144, see FIG. 11, by means well known to those skilled in the art, operating valves 146 which control a supply of air 148 to air cylinders 100, to cause air cylinders 100 to retract pistons 102 thereby moving sizing means 88, 90, and hence sizing wheels 94, apart. For the first pass of log L through the sawmill, the operator manually aligns upper carriage 46 at the same height as the midpoint of log L so that it will chip a slab 150 (see FIG. 7, taken along the line 7—7 shown in FIG. 2) from log L, saw S being aligned along vertical cut line 152. It should be understood that slab 150 could alternatively be removed by saw S, if desired, with upper carriage 46 spaced away from log L during the first pass, but such an alternative operation would leave slab 150 intact and not chipped into wood chips as does the preferred method of operation, and would therefore be less desirable.

When log L first begins moving toward saw S and before slab 150 is removed, beam 122 will strike log L at point 154 and become interrupted, causing air cylinders 100 to move sizing wheels 94 together to strike log L at points 156, 158. Points 156 and 158, in the next pass of log L along rails R, will locate and determine the top and bottom of the next board cut, in a manner hereinafter described.

As carriages 92 move towards each other, they urge rods 126, 128 downwardly and upwardly, respectively, by angle brackets 160 attached to carriages 92 which hit adjustable stops 162 on rods 126, 128. Adjustable stops 162 are secured to rods 126, 128 by securing means such as screws, not shown, and are adjusted on rods 126, 128 so that, when sensors 138 sense rings 134, chipping blades 36 are positioned for cutting the top and bottom edges, 27, 29 of a board as determined by extrema of travel 156, 158 of sizing wheels 94. It should be noted that, while wheels 94 will move upwardly and downwardly in response to the varying thicknesses of the log as it passes in contact with them, rods 126, 128 only are urged toward each other and log L, not apart, by angle brackets 160 in contact with adjustable stops 162. Friction at split bushings 142 therefore causes top rod 126 to locate and stay at an extremum point corresponding to the lowest point 156 of the top of log L, and causes bottom rod 128 to locate and stay at an extremum point corresponding to the highest point 156 of the bottom of log L, along the total length of the log.

Once slab 150 has been chipped off the log by upper chipper blades 36, and log L passes completely by beam 122, the beam will once more become unbroken, and wheels 94 will move apart under the direction of control means 144 operating positioning means 98. Pistons 130 will remain at a position corresponding to the narrowest points 156, 158 of log L, and the log will begin moving back to the leftmost (i.e., rearmost) position shown in FIG. 1 for another pass. As the log moves rearwardly, beam 122 will not be broken, as slab 150 has been removed. During the rearward pass, the operator will press a "SET" button 164 on control panel P, causing control means 166, responsive to "SET" button 164, to actuate valves 168 controlling a supply 170 of hydraulic fluid under pressure to hydraulic cylinders 56, in a manner well known to those skilled in the art, causing carriages 46 to move until each sensor 138 detects the metallic ring 134 around each respective piston 130, at which point the motion of each carriage 46 will independently stop under control of control means 166 which closes valves 168, in a manner that will now be apparent. It will be understood that chipper blades 36 are now positioned vertically to cut off portions 172, 174 of log L, but will be located to the left of line 152 in FIG. 7, as log L has not yet made any transverse movement with respect to rails R from its position on the aforementioned first pass that removed slab 150.

When both cutters have sensed and stopped at the correct vertical position, control means 166, opening valve 176, will cause air to flow from air supply 148 through hose 178 and through lower hollow rod 128 into the chamber 180 within cylinder 132 between pistons 130, propelling rods 126, 128 apart, in a manner that will now be understood, for another pass of log L. This positioning of carriages 46, and hence, blades 36, and the resetting of rods 126, 128 shall be understood to happen While log L is moving in the reverse direction towards its leftmost starting position shown in FIG. 1.

Figure 7:
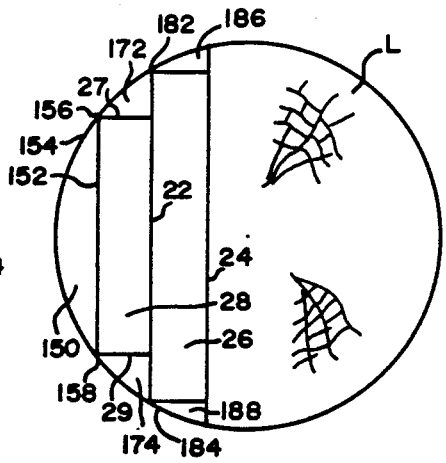
FIG. 7 is a cross-sectional view of a log taken as along the line 7—7 shown in FIG. 2, showing the successive boards that are cut therefrom.

At this point, the conventional sawmill apparatus causes log L to advance transversely to its direction of travel along rails R, in a manner well known to those skilled in the art, so that saw S becomes aligned along vertical cut line 22 shown in FIG. 7. As the log moves forward past apparatus 20 and toward saw S, chipper blades 36 will chip portions 172, 174 from log L, producing the second and third sides of board 28, whose first side was formed along line 152 when slab 150 was removed. While this chipping is occurring, beam 122 will again be interrupted, striking log L on portion 172 above board 28, and wheels 94 will move together, sizing the log for the next pass through, meeting log L at points 182, 184, and operating in the same manner as previously described. When log L passes saw S, saw S will cut log L along cut line 22, and board 28 will fall off, fully formed. Again, as the log begins to reverse direction, the operator will press "SET" button 164, and chipper blades 36 will be positioned to remove portions 186, 188 on the next forward pass, beam 122 will remain unbroken since board 28 has been removed, and operation continues in a manner similar to before.

As a refinement, a multiplicity of metallic sensors 190 are attached to upper air cylinder 100 for sensing the vertical position of piston rod 102 therein. An appropriate one of sensors 190 is chosen so that wheel 94, when fully retracted from log L as controlled by control means 144, is just above log L, so that the downward travel time of upper carriage 92 is minimized, enabling wheel 94 to reach log L soon after beam 122 is broken. Such sensors are not needed on air cylinder 100 of lower sizing means 90, as the lower portion of log L is always a substantially constant distance above the floor, resting on carriage C, necessarily causing lower sizing carriage 92 to have a lesser and more substantially constant travel distance than upper carriage 92, which must travel downwardly to meet varying sizes of logs.

Figure 8:
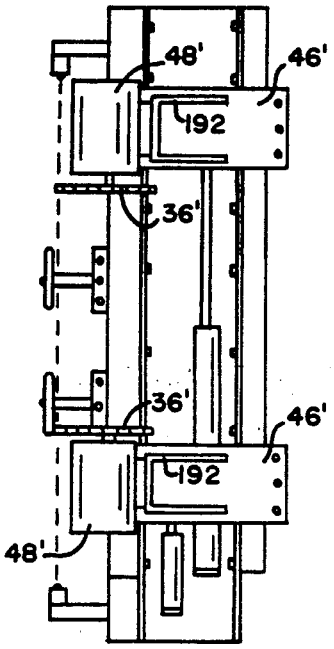
FIG. 8 is a front view of the second preferred embodiment of the present invention showing the motors and carriages.
Figure 9:
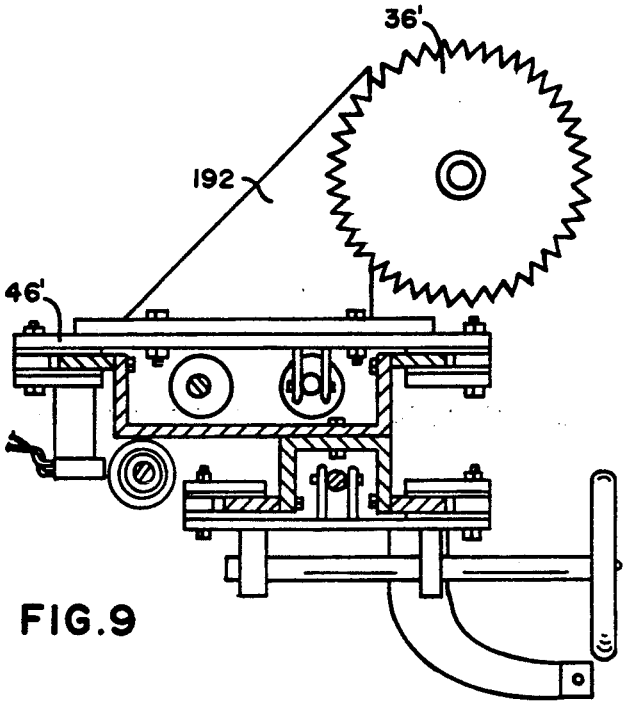
FIG. 9 is an enlarged top sectional view of the second preferred embodiment of the present invention, similar to the view of the first embodiment in FIG. 6, showing the details thereof.

In an alternate embodiment, shown in FIGS. 8 and 9, the horizontal chipper motors 48 and chipper blades 36 are replaced by vertical motors 48' with saw blades 36'. Vertical motors 48' may be mounted on brackets 192 of upper and lower carriages 46'. Operation is similar to before, except that saw blades 36' now cut top and bottom edges 27, 29, see FIG. 7, of the boards sawed off of log L, and slab 150 is sawed off by saw S. It shall be understood that chipper blades, such as in the first embodiment except rotating on a vertical shaft, may also be used in the second embodiment instead of saw blades 36', without departing from the scope of the present invention.

A third embodiment of the present invention is shown in FIGS. 12–15. In this third embodiment, the sizing means is removed from the mast upon which the cutting means slides, and two similar masts, front and rear, respectively, 64 and 64', are adjacently and fixedly attached at their respective back portions 69, 69', as by bolts 80'. Front carriages 46 on front mast 64 are the same as those in the first embodiment. Additionally, upper motor 48'' is seen to be horizontally offset from lower motor 48 for improved chipping of the slab 150, see FIG. 7, from the side of log L, as shown in FIG. 14. Rather than having a single chipping blade 36 placed at the midpoint of log L, as previously described, to chip slab 150, the horizontal offset of the upper and lower chipper motors, 48'', 48 relative to each other allows each chipping blade 36'', 36 to cut only half the log's slab 150. It can be seen that such an arrangement can be viewed in two alternative ways: first, as providing almost twice the chipping power for a given size slab, or, second and alternatively, as providing the capability to cut a larger width slab from a log than would be possible were only a single, midpoint-placed chipper to be used. It shall be understood that this relative horizontal offsetting of the chipper motors could be used as well in the first embodiment, previously described, of the present invention.

Rear mast 64' is similar to front mast 64, but, rather than having upper and lower chipper motors instead has upper and lower vertical motors 202 mounted on upper and lower carriages 200, with saw blades 204' and 204 respectively attached to the shafts of motors 202. The construction of carriages 200 is substantially similar to the construction of carriages 46, previously described, and all four carriages are independently positionable by similar positioning means 54, 54', just as in the first and second embodiments. As shown in FIG. 15, the two independently positionable saw blades 204, 204' allow portions 206 and 206' of log L to be formed into separate boards from a different, and typically lower grade portion 208 of log L. At the same time chipper blades 36" and 36 form the upper edge of portion 206 and lower edge of portion 206', upper saw blade 204' forms the lower edge of upper portion 206 and the upper edge of portion 208, while lower saw blade 204 forms the lower edge of portion 208 and the upper edge of lower portion 206'. Such flexibility may be utilized when knots or other defects present in portions 206 and 206' would otherwise lower the grade of boards cut from log L; by providing the capability for isolating lower grade portions of log L from higher grade portions, more efficient utilization of the log can be achieved. It shall be understood that if defects only exist in one of portions 206 or 206', it is not necessary to have both blades 204 and 204' cut into log L. Similarly, if no defects exist, both blades 204 and 204' may be moved out of the path of log L, and a single board can be edged from the log, as in the first and second embodiments. Furthermore, while both upper and lower vertical motors 202 on upper and lower carriages 200 are preferred, it shall be understood that only a single carriage 200 on rear mast 64 could be provided (i.e., one carriage could be left off) if only upper and lower board portions are desired.

In a fourth embodiment of the present invention, shown in FIG. 17 and similar to the variation between the first and second embodiments previously described, the upper and lower chippers of the third embodiment are replaced by vertical chipping motors, not shown but similar to motors 202 or, as shown in FIG. 8, motors 48' with saw blades 36'. The operation of saw blades 36' is just as in the second embodiment, while the operation of the upper and lower saw blades (e.g., 204) on rear mast 64' is as described in the third embodiment.

It shall be understood that a preferred variation of the construction of the third and fourth embodiments of the present invention exists, as shown in FIG. 18, whereby the back portion 69 of front mast 64 is formed as an integral single piece with the back portion 69' of rear mast 64'. Such a construction may utilize a standard "H-beam" for back portions 69, 69' and sidewalls 65, 65', of masts 64, 64', with machined face portions 67, 67' being appropriately placed for mating with edges 63, 63' of flanges 66, 66' as previously described, secured as by bolts 68, 68'.

FIGS. 19–25 show various improvements and variations upon the heretofore described embodiments of the present invention. Although only a single rear cutting means, comprising carriage 290, vertical motor 292, and saw blade 294, is shown on the rear side of mast 316, it shall be understood that an upper and lower rear cutting means could also be provided, if desired, as shown in FIGS. 12–15. It shall also be understood that while the upper and lower cutting means 30' and 32' on the front side of mast 316 are shown as chippers, similar to FIGS. 12 and 13, saws could be also used for edging as shown in FIG. 17, heretofore described as the fourth embodiment of the present invention.

Referring to FIGS. 19–22, the sizing means 300, rather than being mechanical sizing means such as sizing wheels, has been replaced by upper and lower optical measurement means, 302 and 304, for optically determining the vertical minimum and maximum points of the upper and lower surfaces, respectively, of the log L. Each upper and lower optical measurement means 302, 304 will be similar, preferably having a light source 306 passing through a lens 308. Light from light source 306 will strike the surface of log L and reflect back to the optical measurement means, passing through another lens 310 and then impinging upon a well-known charge-coupled device (CCD) 312. Upper and lower optical measurement means 302 and 304 are positioned and mounted so that their light beams are reflected from the log at the same points previously touched by sizing wheels 94. As shown in FIG. 22, variously sized logs L', L, and L" will cause the reflected light beams 313', 313, 313" to respectively strike the CCD device 312 at different points. The distance 314 from the measurement means 302 to the log L can be determined by well-known methods of triangulation once the point at which the light beam strikes CCD device 312 is output by the CCD device in a manner well-known to those skilled in the art.

A suitable measurement means device for use as measurement means 302 and 304 is the optical triangulation probe sold in the United States under the trademark "SELCOM OPTOCATOR" by Selective Electronic, Inc., P.0. Box 250, Valdese, N.C. 28690. This device produces a 4 to 20 mA signal corresponding to a measurement within some specified range of 0 to 1024 mm. The device can be adjusted to produce an output signal of 20 mA for some nominal measurement distance, and also to produce an output signal of 4 mA for that nominal measurement distance plus 1024 mm It shall be understood that, when used in combination with the present invention, the device will be suitably adjusted and mounted so that this range of 0 to 1024 mm will accommodate the minimum and maximum points on the upper and lower surfaces, respectively, of log L for variously sized logs.

While it is only necessary that optical measurement means 302 and 304 view the upper and lower surfaces of log L as log L passes the cutting means, as previously described, measurement means 302 and 304 can be preferably mounted upon mast 316 as shown. It shall be understood that there is no particular need for measurement means 302 and 304 to be mounted upon mast 316, only that the measurement means view the surfaces of log L for measurement and recording the maximum and minimum values as the log is edged, in a similar manner as that previously described with the mechanical sizing wheels.

Another related improvement of the present invention involves the use of transducer or sensor means 318, performing a similar function to that performed by magnetic sensors 138 shown in FIG. 10. As shown in FIGS. 21 and 24, magnets 320 are mounted on each upper and lower carriage 46 for sensing by sensor means 318 which then determines the instantaneous vertical position of each carriage 46. A suitable device for sensor means 318 is the dual-channel magnetic transducer probe sold under the trademark "TEMPOSONICS II" by MTS Systems Corporation, Sensors Division, Research Triangle Park, N.C. 27708, which senses the position of two magnets along a rod, such as rod 322, where the magnets are constrained to never pass each other.

Figure 11:
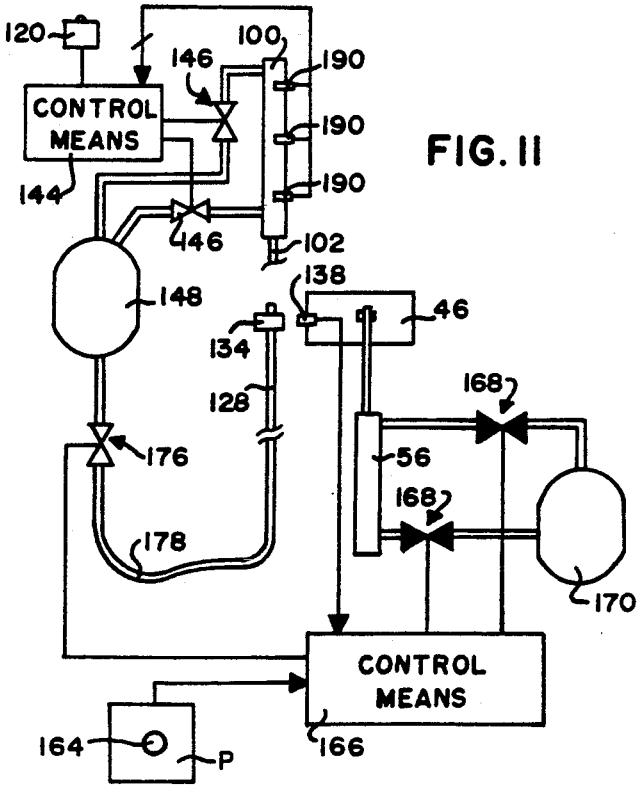
FIG. 11 is a schematic block diagram showing the interconnection of the various sensors and control means.

In the previous embodiments using mechanical sizing wheels 94, a sensing means, such as electric eye 116 and light detector 120 shown in FIGS. 2 and 11 was used to detect the passage of log L between sizing wheels 94. Because of the very real and finite delay between the detection of the interruption of light beam 122 and the mechanical response of wheels 94 being urged toward log L, aberrations in the size of the log near the ends of the log were ignored, as they should be. The use of optical measurement means 302 and 304, with their corresponding quickness of response and measurement, dictates that sensing means be employed for detecting when the midportion, not the forward or rearward end portions, of the log is being viewed by optical measurement means 302 and 304 so that measurement aberrations at the ends of the log may be ignored. Such aberrations might occur if, for instance, the log were cut crookedly at one or both ends.

Therefore, in the improved embodiment of the present invention having optical measurement means, there will also be preferably provided sensing means, such as electric eyes 324 and 326, for detecting when the midportion of log L is being viewed by upper and lower optical measurement means 302 and 304. Electric eyes 324 and 326 each respectively have a light 328, 330 and a light detector 332, 334 placed along the path of log L in a similar manner to electric eye 116, previously described, but leadingly and trailingly offset from the viewing points of optical measurement means 302 and 304. In the preferred embodiment, electric eye 324 is placed approximately six (6) inches before optical measurement means 302 and 304, and electric eye 326 is placed approximately six (6) inches after optical measurement means 302 and 304. By causing the measurements taken by optical measurement means 302 and 304 to be ignored, in a manner hereinafter described, unless log L is interrupting the beams of both electric eyes 324 and 326, it will be understood that these electric eyes become sensing means for detecting when a midportion 336 of log L, as opposed to the forward 338 and rearward 340 end portions of log L, are being viewed by optical measurement means 302 and 304. By examination of FIGS. 19 and 20, the forward end portion 338 of log L is seen to be defined by a certain distance at the forward end of log L, where that distance is equal to the distance from optical measurement means 302 and 304 to electric eye 326, while the rearward end portion 340 of log L is seen to be defined by a possibly different certain distance at the rearward end of log L, where that distance is equal to the distance from optical measurement means 302 and 304 to electric eye 324. The midportion 336 of log L is simply that portion of log L between the two end portions 338 and 340.

Figure 19:
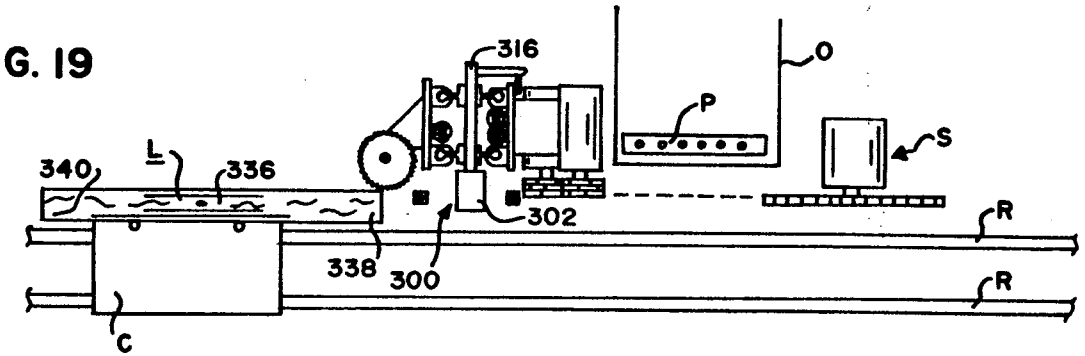
FIG. 19 is a top plan view showing an improvement of the present invention in use alongside a conventional sawmill, with linear slide bearings on the mast and optical sizing means.
Figure 20:
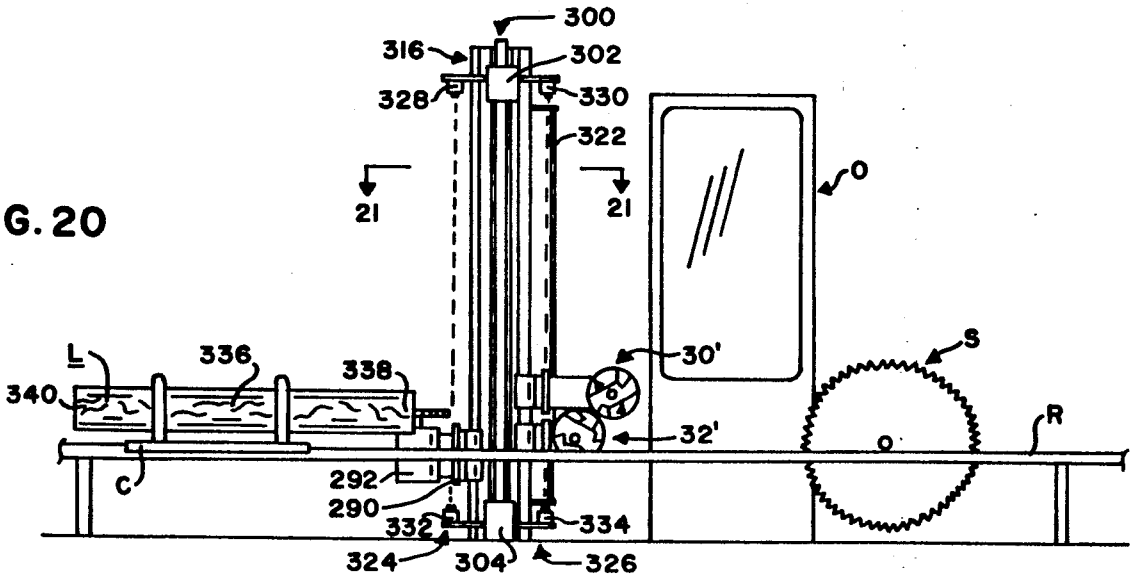
FIG. 20 is a side view of the invention shown in FIG. 9.

Referring to FIGS. 19, 20, and 24, the operation of this improvement upon the present invention is similar to that previously described. Log L begins at the far left of FIGS. 19 and 20. During the first pass of log L past the edging apparatus, a slab will be removed from the log L. Control means 166', preferably a well-known programmable controller or central processing unit (CPU), will continually monitor the continuity of the light beams to detectors 332 and 334, and, when both detectors indicate that log L is interrupting their respective light beams, begin recording the measurement values from optical measurement means 302 and 304. Control means 166' will compare each measurement value with the previous one, saving the maximum values measured by measurement means 302 and 304, corresponding to the narrowest points on log L, as long as both detectors 332 and 334 indicate the interruption of their light beams, thereby determining the vertical minimum and maximum points of the upper and lower surfaces, respectively, of log L along midportion 336, but ignoring aberrations at the forward and rearward ends 338 and 340.

On the rearward pass of log L past the edger, control means 166' will operate proportional valves 168 between pressurized hydraulic fluid supply 170 and hydraulic cylinders 56, thereby moving upper and lower carriages 46 in a manner now understood by those skilled in the art. Simultaneously, control means 166' will sense the output from sensor means 318 and adjust valves 168 until carriages 46 are properly positioned to edge a board from log L in a manner similar to that previously described, preferably under the direction of the sawmill operator who presses a button 164, as before. Once log L has returned to its leftmost starting position, the conventional sawmill apparatus will cause log L to advance transversely to its direction of travel along rails R, in a manner well known to those skilled in the art, so that saw S is aligned to cut the next board from log L as that board is edged by the present invention and the location of the edges of the next board to be removed is determined.

The use of a CPU for control means 166' has an additional benefit. Whereas the mechanical sizing means previously described merely allowed positioning the upper and lower cutting means based on the measured narrowest width points along the board, a more flexible certain function of the extreme vertical minimum and maximum points along the log can now be provided. For example, the operator's panel P' may be provided with a switch 342 for indicating to control means 166' whether hardwood or softwood boards are being edged. When creating hardwood boards, it is customary to edge as wide a board as possible, i.e., with the board extending from the lowest upper surface point recorded to the highest lower surface point recorded. Therefore, when edging hardwood boards, control means 166' will be commanded to move and position the blades of the upper and lower cutting means as a first certain function of the extreme vertical minimum and maximum points recorded for the midportion of the log, where that first certain function is defined to choose the widest board possible for the given recorded values.

However, when edging softwood boards, it is customary to create boards having a width that is an even number of inches—i.e., two, four, six, etc. inches. Therefore, when edging softwood boards, as indicated by switch 342, control means 166' will move and position the blades of the upper and lower cutting means as a second certain function of the extreme vertical minimum and maximum points recorded for the midportion of the log, where that second certain function is defined to choose the largest eve number of inches in width possible for the given recorded values.

In another variation and improvement of the present invention, the sliding attachment means 75' for slidably mounting each carriage on the mast can be chosen to be one or more vertical slide rails attached to the mast, with linear bearing means attached to each carriage for slidable mounting of the carriage to the slide rails, in contrast to the previously described arrangement of a channeled mast with flanges and slides used for sliding attachment means 75.

Referring to FIGS. 21 and 23, mast 316 is shown as preferably being a cold-rolled steel plate, one-inch in thickness, with a horizontally-spaced pair of vertical slide rails 344 attached, as by welding or preferably bolting, to the front side thereof, and with another horizontally-spaced pair of vertical slide rails 346 attached to the rear side thereof. It shall be understood that slide rails 344 and 346 will provide substantial rigidity to mast 316. Secured to front and rear carriages 46 and 290, as by welding or preferably bolting, are linear bearing means 348 and 350, for slidable mounting of each carriage to its respective slide rail. A suitable matched set of slide rails and linear bearing means are manufactured by Thomson Industries, Inc., Port Washington, N.Y., and sold under the trademark "QUICK-SLIDE."

It shall be understood that, while the preferred embodiment has a single mast 316 as shown, with "back-to-back" vertical slide rails on each side, two separate front and rear masts could equivalently be used in a manner that is now apparent.

Another improvement of the present invention is shown in FIG. 25. Here, electric eyes 324 and 326, and therefore, light detectors 332 and 334, are not present, and the sensing of when the midportion of log L is being viewed by upper and lower optical measurement means 302 and 304 is accomplished by another strategy, now described. It should be understood that other various parts of the invention, such as the cutters, the mast, the hydraulic cylinders, etc., have been omitted from FIG. 25 in order to focus on the specific improvements shown therein.

Carriage C, which carries log L, is typically moved back and forth by a well-known cable drum or pulley 360 which drives a cable 362. Cable 362 has one end 364 attached to carriage C, passes around cable drum 360 for pulling movement thereby, passes around another pulley 366, and then has its other end 368 attached to carriage C.

Cable drum 360 typically has a toothed gear 370 secured thereto in axial alignment, with gear 370 being rotatably driven by means well-known to those skilled in the art such as hydraulic motor 372 coupled to gear 370 by chain 374. One of the improvements shown in FIG. 25 is to have relative movement monitoring means 375, such as proximity switch 376, for monitoring the forward and rearward movement of log L. Proximity switch 376, closely spaced from teeth 378 of gear 370, detects the passage of teeth 378 therepast and emits a pulse train 380 for input to control means 166', in a manner well-known to those skilled in the art. These pulses are understood to have a known relationship to the movement of log L, such as, for instance, one pulse for every inch of movement, where this known relationship is readily determined from the diameter of cable drum 360 and the number of teeth on gear 370.

However, proximity switch 376 can only monitor the relative movement of log L, and has no knowledge of the absolute location of end portion 340. Optical measurement means 302 and 304, however, do have the capability of detecting when log L is being viewed, as they will not receive a reflected light beam (313, 313', or 313" as shown in FIG. 22) when no log is being viewed thereby.

Therefore, in this improvement to the present invention, the sensing means for detecting when the midportion of log L is being viewed by upper and lower optical measurement means 302 and 304 includes the combination of optical measurement means 302 and/or 304 with the relative movement monitoring means 375, along with control means 166". When optical measurement means 302 and/or 304 indicates to control means 166', that log L is being viewed, control means 166" will then count successive pulses 380 until the undesired end portion, perhaps six inches, has passed by unobserved, at which point control means 166" will begin observing and recording the distances to the upper and lower surfaces of log L within a vertical plane extending longitudinally through log L, as input to control means 166" by optical measurement means 302, 304, in a manner now understood.

As trailing end portion 340 moves past optical measurement means 302 and 304 from position 340" to position 340', control means 166" will again be informed by optical measurement means 302, 304 that log L is no longer being viewed thereby. Upon this notification, control means 166" can discard the last few measurements taken, thereby ignoring the aberrant shape of end portion 340 of log L, before computing the correct placement of the edgers, as previously described.

However, the inclusion of monitoring means 375, for monitoring the longitudinal movement of log L, allows another improvement in the present invention, hereinafter described. It is well-known in the sawmill industry that, while preferable, boards need not have perfectly square edges nor be completely free from edge defects. Various log grading rules are also well-known in the trade for determining the grade, and hence the value, of a log having edge or corner defects (wanes). Such grading rules are described in Jenks, U.S. Pat. No. 4,541,722, issued Sep. 17, 1985, hereby fully incorporated by reference herein.

Control means 166" then, can periodically sample the position of the upper and lower surfaces of log L as log L moves past optical measurement means 302 and 304, and, by saving these sampled values, build a profile of the upper and lower surfaces of log L. Preferably these samples will be taken at every pulse 380, thereby recording a surface profile at, for example, one inch intervals along log L. Then, by using the well-known log grading rules, control means 166" can move and position the blades of the upper and lower cutting means as a third certain function of the vertical minimum and maximum points recorded for the midportion of the log, where that third certain function is defined to choose the widest board possible for the desired grade of lumber, in view of the upper and lower surface profile previously gathered, by application of the well-known grading rules.

In other words, control means 166", rather than merely determining the extreme vertical minimum and maximum points along the log, instead saves the sampled vertical upper and lower surface location values at various positions along the log, thereby building a profile of the log's upper and lower surfaces in the saw line. To this profile are applied the well-known grading rules in order to determine the required movement and placement, in a manner heretofore described, of the upper and lower cutting means.

Control panel P" for the improvement shown in FIG. 25 preferably has a multi-position switch 342' for indicating the desired grade of lumber to control means 166", thereby causing a particular grading rule to be employed. It shall be understood that, if a perfect edge is desired on the removed board, without any wane, control means 16" will operate as in the earlier embodiments, determining the extreme vertical minimum and maximum points of the upper and lower surfaces of log L, then possibly reducing the board's width to an even number of inches if a softwood board is being edged.

As before, control means 166" controls the various valves 168 to position the upper and lower cutters, and senses the position of the cutters using rod 322 of the transducer/sensor means.

Although the present invention has been described and illustrated with respect to a preferred embodiment and a preferred use therefor, it is not to be so limited since modifications and changes can be made therein which are within the full intended scope of the invention.

I claim:

1. An edger for use with a conventional sawmill, said edger comprising:

(a) upper and lower cutting means for forming the upper and lower edges, respectively, of a board to be removed from a log, each said cutting means comprising:

i. a rotatable blade;

ii. rotation means for rotating the blade; and, iii. positioning means for moving the blade upwardly and downwardly with respect to the log and for positioning the blade for cutting the respective edge of the board when the blade is placed in contact with the log;

(b) sizing means for automatically determining the location of the upper and lower edges of the board to be removed from the log;

(c) control means, responsive to said sizing means, for controlling the moving and positioning of the blade of each said cutting means by each said positioning means.

2. The edger as described in claim 1, in which each said rotation means is a motor, each said motor comprising a horizontal shaft to which each said respective blade is attached, and in which each said respective blade comprises a chipping portion.

3. The edger as described in claim 1, in which each said rotation means is a motor, each said motor comprising a vertical shaft to which each said respective blade is attached.

4. The edger as described in claims 1, 2 or 3, in which the sizing means comprises an upper and a lower wheel means for determining the vertical minimum and maximum points, respectively, of the upper and lower surfaces, respectively, of the log, and in which the sizing means additionally comprises upper and lower position extremum recording means, responsive to the upper and lower wheel means, respectively, for recording the extreme vertical minimum and maximum points, respectively, of the upper and lower surfaces, respectively, of the log.

5. The edger as described in claim 4, in which each position extremum recording means comprises a piston which is operably urged toward the log in response to movement of the respective wheel means, and in which each position extremum recording means further comprises sensor means for detecting the position of each said piston, each said sensor means being operably connected to the control means.

6. The edger as described in claims 1, 2 or 3, in which the sizing means additionally comprises:

(a) an upper and a lower wheel means for determining the vertical minimum and maximum points, respectively, of the upper and lower surfaces, respectively, of the log;

(b) sensing means for detecting the passage of the log between the upper and the lower wheel means;

(c) upper and lower positioning means for urging the upper and lower wheel means, respectively, to be in contact with the upper and lower surfaces, respectively, of the log; and (d) control means, responsive to the sensing means, for controlling the operation of the upper and lower positioning means and for operably causing said upper and lower positioning means to urge the upper and lower wheel means to be in contact with the upper and lower surfaces, respectively, of the log.

7. The edger as described in claims 1, 2 or 3, in which the edger additionally comprises a front mast, and in which each said positioning means additionally comprises a carriage mounted for upward and downward movement on the front mast, each said carriage supporting the respective said rotation means, and in which each said positioning means additionally comprises cylinder means for moving the carriage upwardly and downwardly on the front mast.

8. The edger as described in claims 1, 2 or 3, in which the sizing means comprises upper and lower optical measurement means respectively for optically determining the vertical minimum and maximum points of the upper and lower surfaces, respectively, of the log; and in which said control means is further for recording the extreme vertical minimum and maximum points of the upper and lower surfaces, respectively, of the log.

9. The edger as described in claims 1, 2 or 3, in which said log has a forward end portion, a rearward end portion, and a midportion between said forward and said rearward end portions, and the sizing means additionally comprises:

(a) upper and lower optical measurement means respectively for optically determining the vertical minimum and maximum points of the upper and lower surfaces, respectively, of the log; and (b) sensing means for detecting when said midportion of said log is being viewed by said upper and lower optical measurement means, and in which said control means is further for recording the extreme vertical minimum and maximum points of the upper and lower surfaces, respectively, of the midportion of the log, and in which said control means controls the moving and positioning of the blade of each said cutting means as a certain function of the extreme vertical minimum and maximum points recorded for the midportion of the log.

10. The edger as described in claims 1, 2, or 3, in which the sizing means comprises upper and lower optical measurement means respectively for optically determining the locations of the upper and lower surfaces of the log in a vertical plane, and in which said control means is further for recording the measured locations of the upper and lower surfaces of the log in said vertical plane.

11. The edger as described in claims 1, 2, or 3, in which the sizing means additionally comprises:

(a) upper and lower optical measurement means respectively for optically determining the locations of the upper and lower surfaces of the log in a vertical plane; and (b) movement monitoring means for monitoring the longitudinal movement of the log, said movement monitoring means being operably coupled to said control means, and in which said control means is further for recording the measured locations of the upper and lower surfaces of the log in said vertical plane and also for constructing a profile of said upper and lower surfaces from said measured locations, and in which said control means controls the moving and positioning of each said cutting means as a certain function of said profile.

12. An edger for use with a conventional sawmill, said edger comprising:

(a) a front mast;

(b) upper and lower cutting means for forming the upper and lower edges, respectively, of a board to be removed from a log, each said cutting means comprising:

i. a rotatable blade;

ii. a front carriage mounted for movement on the front mast toward and away from the log;

iii. a motor mounted on the front carriage, said motor including a shaft for rotating the blade; and, iv. a hydraulic cylinder operably connected between the front mast and the front carriage for moving the front carriage toward and away from the log;

(c) a rear mast;

(d) upper and lower sizing means for automatically determining the location of the upper and lower edges of the board to be removed from the log, each said sizing means comprising:

i. a rear carriage mounted for upward and downward movement on the rear mast;

ii. a sizing wheel mounted on the rear carriage for contact with the surface of the log;

iii. an air cylinder operably connected between the rear mast and the rear carriage for moving the rear carriage toward and away from the log;

iv. position extremum recording means responsive to the movement of the rear carriage for recording the extreme movement of the rear carriage toward the log, said position extremum recording means comprising:

1. a piston operably urged toward the log by the movement of the rear carriage toward the log; and, 2. sensor means for detecting the position of the piston of the position extremum recording means;

(e) sensing means for detecting the passage of the log between the sizing wheels of the upper and lower sizing means;

(f) first control means, responsive to the sensing means, for operably causing each respective air cylinder to move each respective rear carriage toward and away from the log; and, (g) second control means, responsive to each said sensor means of each said sizing means, for controlling the movement of each said front carriage toward and away from the log.

13. The edger as described in claim 12 in which the shaft of each motor mounted on each front carriage is horizontal, and in which each said blade comprises a chipping portion.

14. The edger as described in claim 12 in which the shaft of each motor mounted on each front carriage is vertical.

15. An edger for use in a conventional sawmill, said edger comprising:

(a) a vertically upright mast;

(b) upper and lower cutting means for forming the upper and lower edges, respectively, of a board to be removed from a log, each said cutting means comprising:

i. a rotatable blade;

ii. a carriage;

iii. sliding attachment means for slidably mounting said carriage on said mast for upward and downward movement thereupon;

iv. rotation means, mounted on said carriage, for rotating the blade; and v. positioning means for moving the carriage upwardly and downwardly with respect to the log and for positioning the blade for cutting the respective edge of the board when the blade is placed in contact with the log.

16. The edger as recited in claim 15, in which said mast comprises:

(a) a back portion;

(b) a left and a right sidewall, each extending outwardly from horizontally opposite sides of said back portion, each said sidewall being in parallel spaced relationship with the other to form a vertical channel therebetween, said channel having a mouth opening remote from said back portion between said sidewalls; and (c) a left and a right flange, respectively abuttingly and fixedly attached, along an inner edge of each said flange, to said left and right sidewalls distant from said back portion and extending sidewardly in a plane from said sidewalls;

in which each said carriage comprises a vertical base plate extending across said mouth opening of said channel; and in which each said sliding attachment means comprises a left and a right lip respectively attached to horizontally opposite sides of said base plate and slidably engaging the respective left or right flange of said mast on the side of said respective flange remote from said base plate so as to embracingly entrap said respective flange between said lip and said base plate.

17. An edger for use with a conventional sawmill, said edger comprising:

(a) a front and a rear vertically upright mast;

(b) front upper and front lower cutting means on said front mast for forming the upper and lower edges, respectively, of a board to be removed from a log, and rear cutting means on said rear mast for dividing said board into separate board portions, each said cutting means on said front and rear masts comprising:

i. a rotatable blade;

ii. a carriage;

iii. sliding attachment means for slidably mounting said carriage on said mast for upward and downward movement thereupon;

iv. rotation means, mounted on said carriage, for rotating the blade; and v. positioning means for moving the carriage upwardly and downwardly with respect to the log and for positioning the blade for cutting the respective edge of the board when th blade is placed in contact with the log.

18. The edger as recited in claim 17, in which each said mast comprises:

(a) a back portion, said back portion of said front mast being adjacent and fixedly attached to said back portion of said rear mast;

(b) a left and a right sidewall, each extending outwardly from horizontally opposite sides of said back portion, each said sidewall being in parallel spaced relationship with the other to form a vertical channel therebetween, said channel having a mouth opening remote from said back portion between said sidewalls; and (c) a left and a right flange, respectively abuttingly and fixedly attached, along an inner edge of each said flange, to said left and right sidewalls distant from said back portion and extending sidewardly in a plane from said sidewalls;

in which each said carriage comprises a vertical base plate extending across said mouth opening of said channel; and in which each said sliding attachment means comprises a left and a right lip respectively attached to horizontally opposite sides of said base plate and slidably engaging the respective left or right flange of said mast on the side of said respective flange remote from said base plate so as to embracingly entrap said respective flange between said lip and said base plate.

19. The edger as recited in claim 17, in which each said mast comprises:

(a) a back portion, said back portion of said front mast being an integral single piece with said back portion of said rear mast;

(b) a left and a right sidewall, each extending outwardly from horizontally opposite sides of said back portion, each said sidewall being in parallel spaced relationship with the other to form a vertical channel therebetween, said channel having a mouth opening remote from said back portion between said sidewalls; and (c) a left and a right flange, respectively abuttingly and fixedly attached, along an inner edge of each said flange, to said left and right sidewalls distant from said back portion and extending sidewardly in a plane from said sidewalls;

in which each said carriage comprises a vertical base plate extending across said mouth opening of said channel; and in which each said sliding attachment means comprises a left and a right lip respectively attached to horizontally opposite sides of said base plate and slidably engaging the respective left or right flange of said mast on the side of said respective flange remote from said base plate so as to embracingly entrap said respective flange between said lip and said base plate.

20. The edger as recited in claims 16, 18, or 19 in which the carriage of each said cutting means additionally comprises wear strips sandwiched between each said left and right lip and the respective said left and right flange on the side of said respective flange remote from the bas plate, and also in which the carriage of each said cutting means additionally comprises wear strips sandwiched between each said left and right flange and said base plate.

21. The edger as recited in claim 20 in which said left and right sidewalls each have a machined and substantially flat outer face portion distant from said back portion against which the inner edges of the respective left and right flanges are abuttingly and fixedly attached.

22. The edger as recited in claim 21 in which each said positioning means of each said cutting means comprises a hydraulic cylinder having an extendable and retractable piston, said hydraulic cylinder being placed within said vertical channel of, and attached to, said mast upon which said respective carriage of each said cutting means is slidably mounted, and in which said retractable piston is attached to said respective carriage of each said cutting means.

23. The edger as recited in claim 15 in which said mast includes a vertical slide rail attached thereto, and in which each said sliding attachment means includes a linear bearing means attached to said carriage for slidable mounting of said carriage to said slide rail.

24. The edger as recited in claim 17 in which each said mast includes a vertical slide rail attached thereto, and in which each said sliding attachment means includes a linear bearing means attached to said carriage for slidable mounting of said carriage to the slide rail on the same mast as said carriage.

25. An edger for use with a conventional sawmill, said edger comprising:

(a) a vertically upright mast having a front side and a rear side, each said side having a vertical slide rail attached thereto;

(b) front upper and front lower cutting means on said front side for forming the upper and lower edges, respectively, of a board to be removed from a log, and rear cutting means on said rear side for dividing said board into separate board portions, each said cutting means on said front and rear sides comprising:

i. a rotatable blade;

ii. a carriage;

iii. sliding attachment means for slidably mounting said carriage on said mast for upward and downward movement thereupon, said sliding attachment means comprising a linear bearing means attached to said carriage for slidable mounting of said carriage to the slide rail on the same side of said mast as said carriage;

iv. rotation means, mounted on said carriage, for rotating the blade; and v. positioning means for moving the carriage upwardly and downwardly with respect to the log and for positioning the blade for cutting the respective edge of the board when the blade is placed in contact with the log.

* * * * *